US006505982B2

(12) United States Patent
Edenlund et al.

(10) Patent No.: US 6,505,982 B2
(45) Date of Patent: Jan. 14, 2003

(54) PRINTER WITH IMPROVED LABEL DISPENSING

(75) Inventors: Elvira Edenlund, Göteborg (SE); Peter Gustafsson, Kållered (SE)

(73) Assignee: Intermec Printer AB (SE)

( * ) Notice: Subject to any disclaimer, the term of this patent is extended or adjusted under 35 U.S.C. 154(b) by 0 days.

(21) Appl. No.: 09/758,882

(22) Filed: Jan. 11, 2001

(65) Prior Publication Data

US 2001/0007620 A1 Jul. 12, 2001

(30) Foreign Application Priority Data

Jan. 12, 2000 (SE) ..... 0000063

(51) Int. Cl.[7] ..... B41J 11/26
(52) U.S. Cl. ..... 400/618; 400/611
(58) Field of Search ..... 400/615.2, 611, 400/618, 621; 101/288

(56) References Cited

U.S. PATENT DOCUMENTS 3,792,807 A * 2/1974 Mare et al. ..... 225/100
6,145,561 A * 11/2000 Watanabe et al. ..... 156/517
6,231,253 B1 * 5/2001 Henderson et al. ..... 400/618

FOREIGN PATENT DOCUMENTS

JP 10-264915 * 10/1998

* cited by examiner

*Primary Examiner*—Stephen R. Funk
*Assistant Examiner*—Minh H. Chau
(74) *Attorney, Agent, or Firm*—Orum & Roth

(57) ABSTRACT

The invention relates to a printer with improved label dispensing, and more particularly a printer in which the label is prevented from adhering to the backing paper during the dispensing. The printer comprises a print head (1) for printing labels (4) attached by an adhesive layer to a backing paper (5), a path (2) along which the backing paper together with the labels is brought in front of the print head and on to a dispensing edge (3) at which the backing paper is to be deflected while the labels are released from the backing paper and dispensed in a substantially straight direction. According to the invention, the printer comprises means for moving or removing electric charges. In one embodiment of the invention, the dispensing edge (3) is coated with a material removing charges from the backing paper (5), while another embodiment of the invention is provided with a device that generates an electric field moving electric charges of the labels and the backing paper. The invention enables the use of the effect of electrostatical charges in the label and backing paper in a controlled and positive way. Thus, a repellent electric force is created assisting the ejection and separation of the label from the backing paper.

6 Claims, 2 Drawing Sheets

PRINTER WITH IMPROVED LABEL DISPENSING

FIELD OF THE INVENTION

The present invention relates to a printer with improved label dispensing, and more particularly a printer in which the label is prevented from adhering to the backing paper during the dispensing. The invention enables a neutralisation of the effect of electrostatical charges in the label and backing paper by charging the backing paper or displacing the electric charges contained therein. Thus, a repellent electric force is created assisting the ejection and separation of the label from the backing paper.

STATE OF THE ART

It is common in printers to dispense and separate the labels from the backing paper by deflecting the backing paper around a dispensing edge to force the labels to be released and move forward in a straight direction. Usually the label is made from a more rigid material than the backing paper. When using thinner materials for the label, this may cause problems, as the label is not sufficiently rigid but is brought together with the backing paper around the dispensing edge. Furthermore, the label is attached to the backing paper by means of an adhesive that should be sufficiently strong, so that the labels do not become unstuck within the printer prematurely. Also, the adhesive should be sufficiently strong for adhesion when the label is dispensed and applied on a product, e.g. on a box or a package.

The labels and the backing paper are also subjected to electrostatic charging when the labels and backing paper travels through the printer and is brought in contact with various parts. Especially the print head may be covered by a glass coating charging the labels as they pass. The backing paper is on the other hand connected to ground to avoid electrostatic discharges within the printer. Such discharges may damage the printer's electronic units. Also, the dispensing edge is usually made of metal. The electrostatic charge of the label creates attractive forces between the label and the backing paper (see FIG. 2 described more in detail below).

The present invention solves this problem by removing or equalising the electrostatic charge applied to the backing paper. This creates a repellent force assisting the dispensing edge in ejecting the label forward in a straight direction.

SUMMARY OF THE INVENTION

The invention provides a printer with improved label dispensing, comprising a print head for printing labels attached by an adhesive layer to a backing paper, a path along which the backing paper together with the labels is brought in front of the print head and on to a dispensing edge at which the backing paper is to be deflected while the labels are released from the backing paper and dispensed in a substantially straight direction.

According to the invention, the printer comprises means for moving or removing electric charges, so that a force is created assisting the release of the labels from the backing paper. In one embodiment of the invention, the dispensing edge is coated with a material removing charges from the backing paper, while another embodiment of the invention is provided with a device that generates an electric field moving electric charges of the labels and the backing paper.

The invention is defined in the attached claim 1. Preferred embodiments are set forth in the dependent claims.

BRIEF DESCRIPTION OF THE DRAWINGS

The invention will be described in detail with reference to the accompanying drawings in which.

DETAILED DESCRIPTION OF PREFERRED EMBODIMENTS

The problem mentioned above is common in printers, thermoprinters as well as inkjet printers and others. The present invention is illustrated with reference to a thermoprinter with a thermoprinting head applying heat to the label or a heat sensitive ribbon. However, the invention is not restricted to this application.

Figure 1:
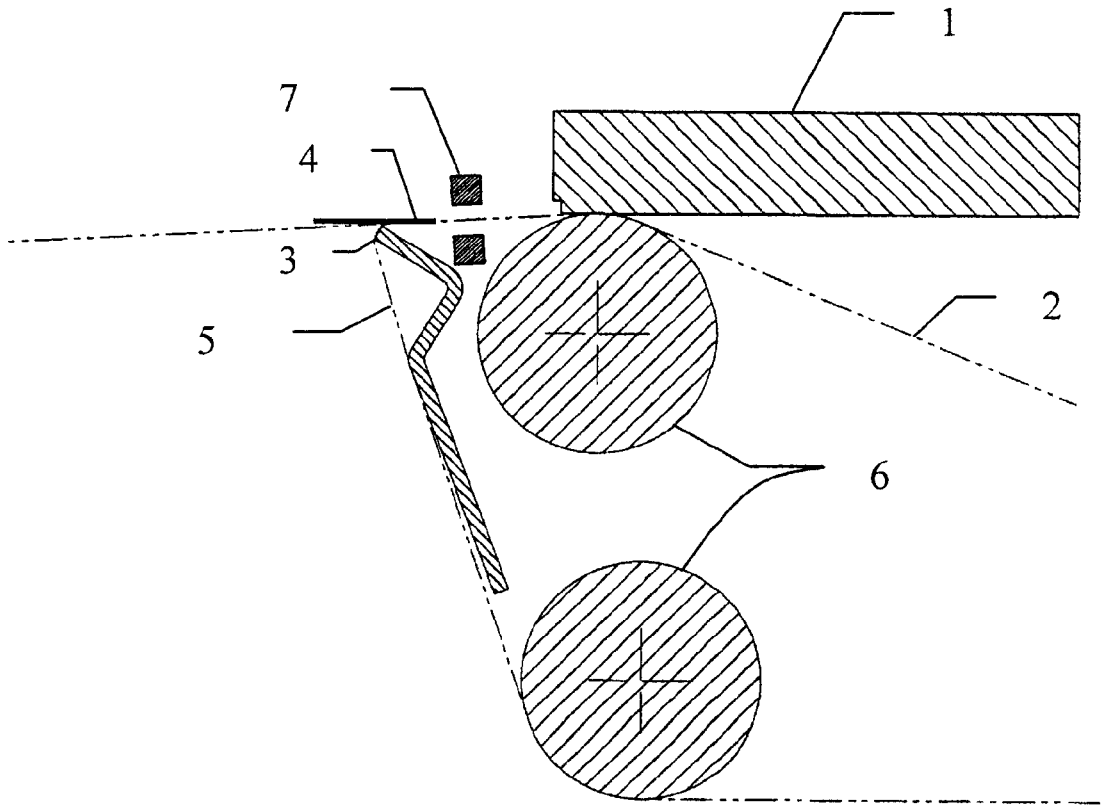
FIG. 1 is a schematic drawing of a printer according to the invention.

In FIG. 1, an exemplifying printer is illustrated in schematic form. The printer comprises a print head 1. A backing paper with labels is fed along a path 2 past the print head 1 and to a dispensing edge 3. At the dispensing edge 3 the respective label 4 is supposed to continue in a straight direction while the backing paper 5 is deflected sharply and collected on a reel (not shown). Several rolls of which two rolls are shown at 6 perform the feeding of the backing paper 5.

Figure 2:
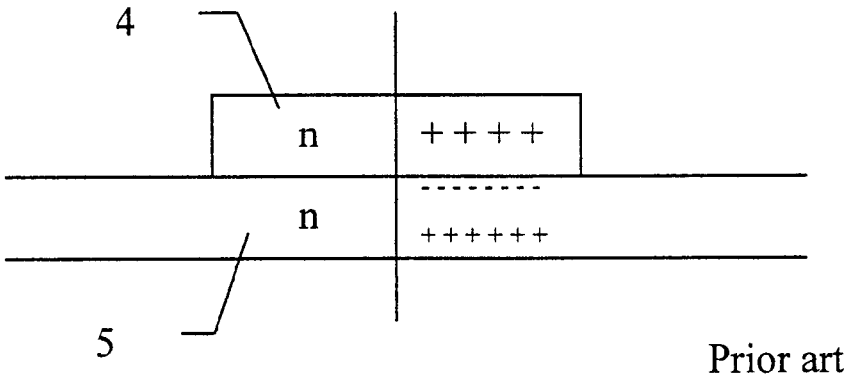
FIG. 2 is a schematic diagram of the electric charges in a label and backing paper using a printer according to the prior art.

FIG. 2 illustrates the problem with the electrostatic charges as encountered in the prior art. The left hand side of the figure illustrates the situation before the passage in front of the print head and the right hand side illustrates the resulting electrostatical charges. Initially both the label 4 and the backing paper 5 are neutral (n). When the label 4 is brushed against the print head electrodes are removed by the glass coating. Since the electrodes are negative a positive charge remains. The positive charge of the label 4 attracts electrodes in the backing paper 5. Thus, close to the adhesive in the interface between the label 4 and the backing paper 5 an attraction force is created between the positive label 4 and the negative layer at the top of the backing paper 5. Even though the total charges in the backing paper 5 amount to zero, the charges are distributed creating the situation as shown to the right in FIG. 2.

The purpose of the present invention is in general to neutralize the effect of the electrostatic charges in the backing paper. In a first embodiment of the invention, charges are removed from the backing paper, while in a second embodiment of the invention the charges contained in the backing paper are displaced. In both cases the result is that a repellent force is produced in the interface between the label and the backing paper.

Figure 3:
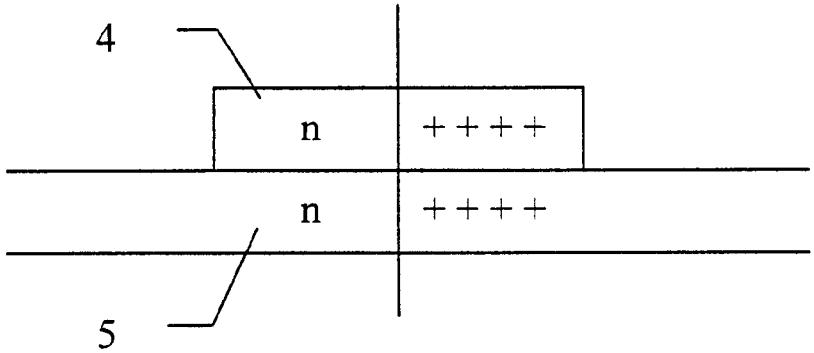
FIG. 3 is a diagram similar to FIG. 2 illustrating a first embodiment of the invention.

In FIG. 3 the effect of the first embodiment of the invention is shown. The dispensing edge 3 is coated with a material removing charges from the backing paper. The coating may be as thin as 0.1 mm and is not visible in FIG. 1. Generally, the charges removed should be of the same type as removed by the print head. In a thermoprinter, the print head is often covered by a glass coating which is very resistant to wear. The glass removes negative charges from the label. Thus, the dispensing edge may also be coated by glass. An alternative is a polymer material which also removes negative charges. The result is that also the backing paper 5 will achieve a positive potential as illustrated to the right in FIG. 3. In this way the repellent force is produced.

Figure 4:
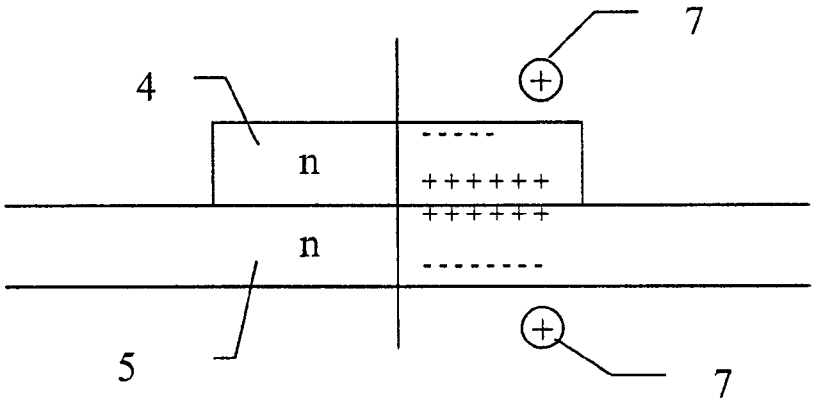
FIG. 4 is a diagram similar to FIG. 2 illustrating a second embodiment of the invention.

FIG. 4 illustrates the effect of the second embodiment of the invention. Here, an electric field is generated for moving the electric charges within the label 4 and backing paper 5. The printer includes a field generating device having two electrodes arranged in close proximity to the label 4 and the backing paper 5, one electrode 7 at each side. The electrodes should have the same potential, illustrated as positive in FIG. 3. The respective negative electrodes are located within the device and not shown. When the label 4 is subjected to the field from the closest electrode, negative charges are moved to the top surface of the label, leaving a positive charge at the interface to the backing paper 5. The charges in the backing paper 5 are moved in the opposite direction, i.e. negative charges are attracted to the lower surface by the lower electrode also leaving a positive charge at the top surface of the backing paper 5, close to the interface to the label 4. Thus, it is seen that a repellent force is created between the label 4 and the backing paper 5. If the electrodes are replaced by two negative electrodes, the polarity of the charges would be reversed, but the effect would still be the same. This is also true if the label was charged to a negative electrostatical charge by the print head.

The device for generating the electric field is not shown in detail here but may easily be designed by a person skilled in the art. The requirement is that the electrodes 7 should have a high voltage, positive or negative. A current limiter should be provided, so that no significant current are discharged from the electrodes, even though the electrodes 7 are not supposed to touch the label 4 and the backing paper.

The invention has been described in detail with reference to a specific embodiment. A person skilled in the art will realize that the specific structure of various parts of the printer is not critical for the application of the invention. The scope of the invention is only limited by the claims below.

What is claimed is:

1. A printer with improved label dispensing, comprising:

a print head for printing labels attached by an adhesive layer to a backing media;

a path along which the backing media together with the labels is transported past the print head, and on to a dispensing edge at which the backing media is deflected, releasing the labels from the backing media and dispensing the labels in a substantially straight direction;

means for moving or removing electric charges, so that a force is created assisting the release of the labels from the backing media, wherein the means for moving or removing electric charges is a material coating on the dispensing edge that removes electric charges from the backing media.

2. The printer of claim 1, wherein the printer is a thermoprinter with a coated print head that removes electric charges having a polarity from the labels, and the material coating on the dispensing edge removes electronic charges of the same polarity from the backing media.

3. The printer of claim 2, wherein the print head is glass coated and the dispensing edge is coated with a glass or polymer material.

4. The printer with improved label dispensing, comprising:

a print head for printing labels attached by an adhesive layer to a backing media;

a path along which the backing media together with the labels is transported past the print head, and on to a dispensing edge at which the backing media is deflected, releasing the labels from the backing media and dispensing the labels in a substantially straight direction;

means for moving or removing electronic charges, so that a force is created assisting the release of the labels from the backing media;

wherein the electric field generating device includes a high voltage source and a current limiter.

5. A printer with improved label dispensing, comprising:

a print head for printing labels attached by an adhesive layer to a backing media;

a path along which the backing media together with the labels is transported past the print head, and on to a dispensing edge at which the backing media is deflected, releasing the labels from the backing media and dispensing the labels in a substantially straight direction;

means for moving or removing electric charges, so that a force is created assisting the release of the labels from the backing media;

wherein the means for moving or removing electric charges is an electric field generating device that induces movement of electric charges in the labels and the backing media;

wherein the electronic field generating device has at least one electrode, proximate to a label side, and at least one electrode proximate a backing media side, the electrodes inducing electronic charges of an identical polarity in the label and the backing media close to an adhesive layer between the label and the backing media.

6. The printer with improved label dispensing, comprising:

a print head for printing labels attached by an adhesive layer to a backing media;

a path along which the backing media together with the labels is transported past the print head, and on to a dispensing edge at which the backing media is deflected, releasing the labels from the backing media and dispensing the labels in a substantially straight direction;

means for moving or removing electric charges so that a force is created assisting the release of the labels from the backing media;

wherein the means for moving or removing electric charges is an electric field generating device that induces movement of electric charges in the labels and the backing media;

wherein the electric field generating device includes a high voltage source and a current limiter.

* * * * *